US008745897B2

(12) United States Patent
Wojnar et al.

(10) Patent No.: US 8,745,897 B2
(45) Date of Patent: Jun. 10, 2014

(54) TRACTION ENHANCING DEVICES FOR FOOTWEAR ASSEMBLIES

(75) Inventors: Christopher J. Wojnar, Portland, OR (US); Casey R. Rakoczy, Portland, OR (US); Aaron Barker, Portland, OR (US)

(73) Assignee: LaCrosse Footwear, Inc., Portland, OR (US)

( * ) Notice: Subject to any disclaimer, the term of this patent is extended or adjusted under 35 U.S.C. 154(b) by 583 days.

(21) Appl. No.: 12/962,380

(22) Filed: Dec. 7, 2010

(65) Prior Publication Data

US 2011/0192054 A1 Aug. 11, 2011

Related U.S. Application Data

(60) Provisional application No. 61/267,787, filed on Dec. 8, 2009.

(51) Int. Cl.
*A43C 15/02* (2006.01)
*A43C 15/06* (2006.01)

(52) U.S. Cl.
USPC ..... 36/59 R; 36/67 B; 36/67 A

(58) Field of Classification Search
USPC ..... 36/59 R, 67 B, 67 A, 67 C, 59 A
See application file for complete search history.

(56) References Cited

U.S. PATENT DOCUMENTS

| | | | | | |
|---|---|---|---|---|---|
| 1,022,106 | A | * | 4/1912 | Murphy | 36/67 C |
| 1,508,533 | A | * | 9/1924 | Richards | 36/59 R |
| 3,587,181 | A | * | 6/1971 | Bernier | 36/59 R |
| 3,600,831 | A | * | 8/1971 | Olsson et al. | 36/59 R |
| 5,634,283 | A | * | 6/1997 | Kastner | 36/61 |
| 6,915,595 | B2 | | 7/2005 | Kastner | |
| 2010/0175280 | A1 | | 7/2010 | Rinehart, Jr. et al. | |
| 2012/0317840 | A1 | | 12/2012 | Wojnar et al. | |

* cited by examiner

*Primary Examiner* — Ted Kavanaugh
(74) *Attorney, Agent, or Firm* — Perkins Coie LLP

(57) ABSTRACT

Traction enhancing devices for footwear assemblies are disclosed herein. In one embodiment, a footwear assembly includes a footwear product with an outsole that has one or more embedded traction enhancing devices. Each traction enhancing device can be a stud that is at least partially embedded in the carrier portion of the outsole and that partially projects from the carrier portion. Each stud can be configured to reduce or eliminate relative movement between the stud and the carrier portion to prevent the stud from loosening or falling out. For example, each stud can include a shaft having an engaging surface, such as a threaded, ribbed, or textured surface, that engages the carrier portion. Each stud can also include a portion having an enlarged surface area, such as an anchor or head, embedded in the carrier portion to improve retention of the stud in the carrier portion.

14 Claims, 5 Drawing Sheets

TRACTION ENHANCING DEVICES FOR FOOTWEAR ASSEMBLIES

CROSS-REFERENCE TO RELATED APPLICATIONS

The present application claims priority to U.S. Provisional Application No. 61/267,787, entitled "TRACTION ENHANCING DEVICES FOR FOOTWEAR ASSEMBLIES," filed Dec. 8, 2009, which is incorporated herein by reference in its entirety.

TECHNICAL FIELD

The present disclosure is directed generally to footwear with enhanced traction features and, more specifically, to embedded traction enhancing devices for use with the sole of a footwear product.

BACKGROUND

Articles of footwear have been designed and worn by humans since early in recorded history. Articles of footwear were initially designed to protect the bottom of the feet of wearers while walking or running over rough surfaces. Although the primary purpose of footwear remains basically unchanged, the various types of activity and surfaces on which wearers run, walk, or stand on have led to an ever increasing diversity in the style and construction of footwear. For examples, humans engage in a wide variety of physical activities, such as walking, running, standing, etc. on a wide variety of surfaces, including slippery surfaces. There is a need for enhanced traction on slippery surfaces, such as ice, snow, etc.

SUMMARY

Embodiments of the present disclosure are directed to traction enhancing devices for footwear. A footwear assembly configured in accordance with one embodiment of the disclosure includes a footwear product, such as a boot, shoe, overshoe, tracking accessory, etc., with an outsole or other carrier portion that has one or more embedded traction enhancing devices. Each traction enhancing device can be a stud that is at least partially embedded in the carrier portion and that partially projects from the carrier portion. Each stud can be configured to reduce or eliminate relative movement between the stud and the carrier portion to prevent the stud from loosening or falling out. For example, each stud can include a shaft having an engaging surface, such as a threaded, ribbed, or textured surface, that engages the carrier portion. Each stud can also include a portion having an enlarged surface area, such as a head, embedded in the carrier portion to improve retention of the stud in the carrier portion.

DETAILED DESCRIPTION

Enhanced traction devices for use with footwear assemblies, and associated methods for using and making such assemblies and devices are described in detail herein in accordance with embodiments of the present disclosure. Certain details are set forth in the following description and Figures to provide a thorough and enabling description of various embodiments of the disclosure. Other details describing well-known structures and components often associated with footwear assemblies and methods of forming such assemblies, however, are not set forth below to avoid unnecessarily obscuring the description of various embodiments of the disclosure.

Many of the details, dimensions, angles, relative sizes of components, and/or other features shown in the Figures are merely illustrative of particular embodiments of the disclosure. Accordingly, other embodiments can have other details, dimensions, angles, sizes, and/or features without departing from the spirit and scope of the present disclosure. Moreover, certain features described with reference to specific embodiments may be combined with other embodiments of the disclosure. In addition, further embodiments of the disclosure may be practiced without several of the details described below, while still other embodiments of the disclosure may be practiced with additional details and/or features.

Figure 1A:
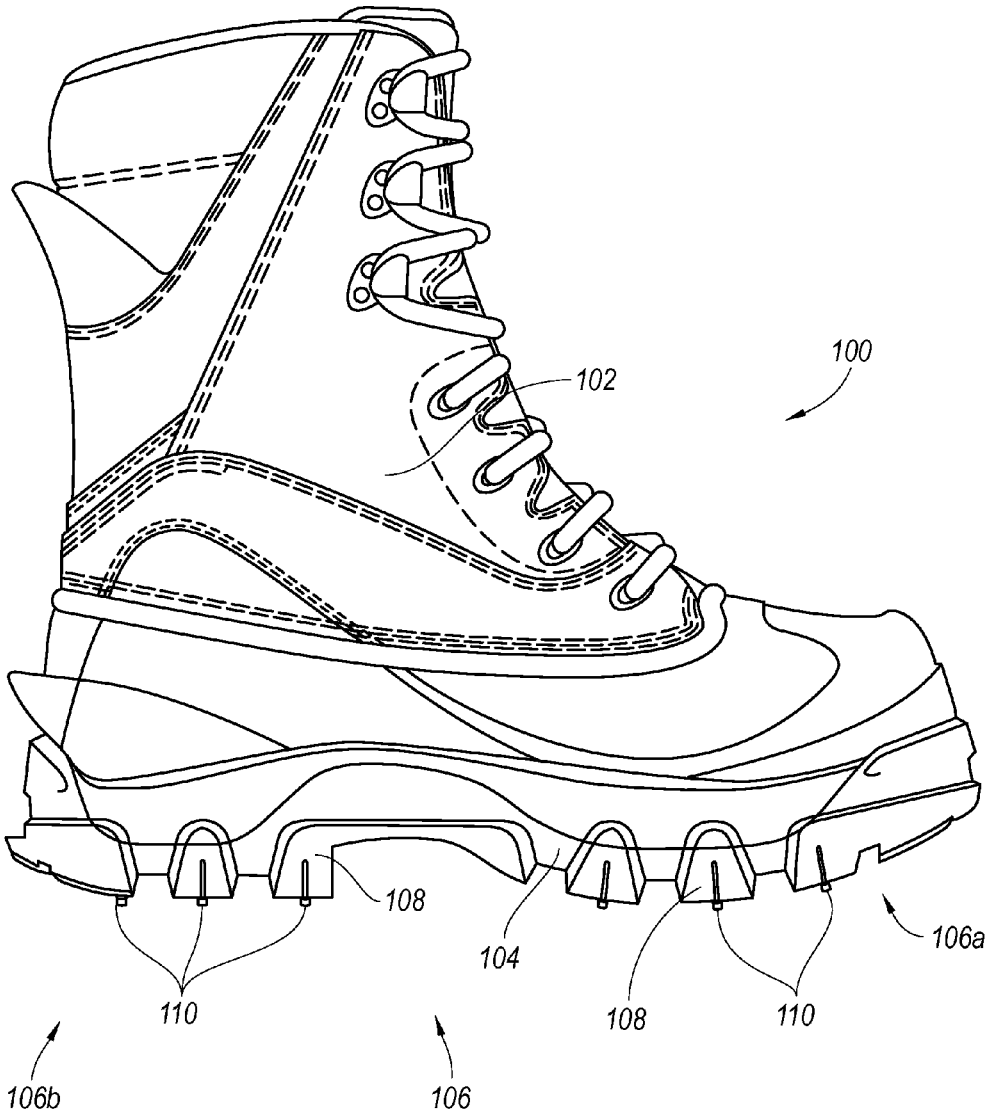
FIG. 1A is a side view and FIG. 1B is a bottom plan view of a footwear assembly configured in accordance with an embodiment of the disclosure.
Figure 1B:
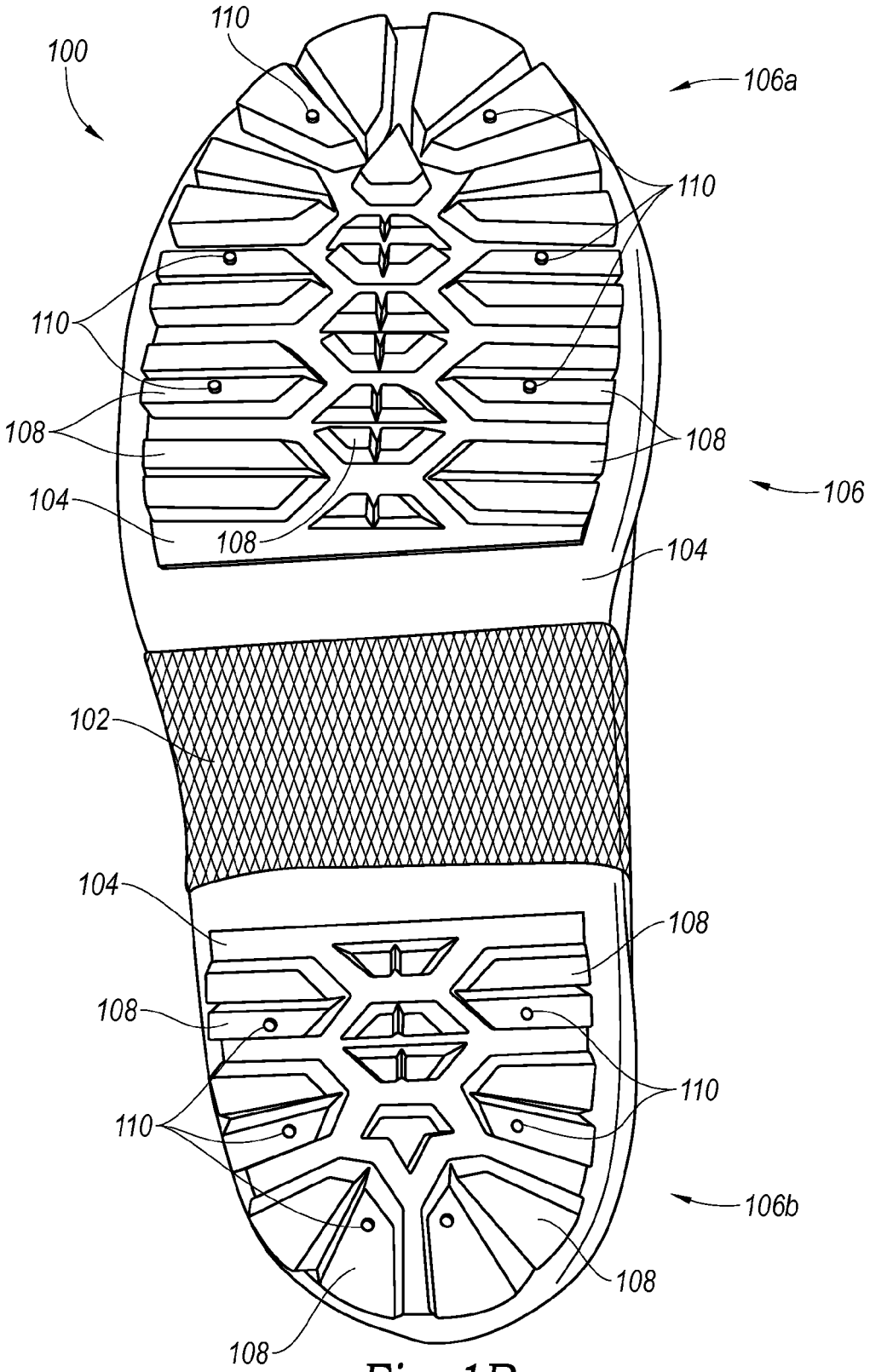

FIG. 1A is a side view and FIG. 1B is a bottom plan view of a footwear assembly 100 ("assembly 100") configured in accordance with an embodiment of the disclosure. Referring to FIGS. 1A and 1B together, the illustrated assembly 100 includes a footwear product 102 that provides enhanced traction for a user in various conditions. For example, as shown in FIG. 1A the footwear product 102 is a boot, and in FIG. 1B the footwear product 102 is an overshoe that can be worn over other types of footwear. As will be appreciated by one of ordinary skill in the relevant art, however, the footwear product 102 can include any article of footwear (e.g., a shoe, sandal, boot, etc.) or an accessory that is attachable to a shoe, boot, sandal, etc., and is not limited to the illustrated embodiment or any specific type of footwear. The footwear product 102 includes a carrier portion or outsole 104 made from rubber or other materials suitable for an outsole of a footwear product 102. The outsole 104 is configured for walking on rough, uneven, or slippery terrain or other surfaces.

In the illustrated embodiment, the outsole 104 includes a tread portion 106 (including, e.g., a forefoot tread portion 106*a* and a heel tread portion 106*b*) with a plurality of gripping features or treads 108 extending from the outsole 104. The treads 108 can be arranged in a variety of patterns to create tread portions 106 for different conditions. In certain embodiments, the treads 108 can be integrally formed with the outsole 104. In other embodiments however, the treads 108 can be removably attached to the outsole 104, for example, with a removable web or similar system, including, for example, the system disclosed in the following patent applications: U.S. Provisional Patent Application No. 61/144,414, entitled "FOOTWEAR ASSEMBLIES WITH REMOVABLE ENHANCED TRACTION DEVICES AND ASSOCIATED METHODS OF USE AND MANUFACTURE," filed Jan. 13, 2009, U.S. Provisional Patent Application No.

61/267,791, entitled "FOOTWEAR ASSEMBLIES WITH REMOVABLE ENHANCED TRACTION DEVICES AND ASSOCIATED METHODS OF USE AND MANUFACTURE," filed Dec. 8, 2009, and U.S. patent application Ser. No. 12/686,919, entitled "FOOTWEAR ASSEMBLIES WITH REMOVABLE ENHANCED TRACTION DEVICES AND ASSOCIATED METHODS OF USE AND MANUFACTURE," filed Jan. 13, 2009, each of which is incorporated herein by reference in its entirety.

In the illustrated embodiment, the treads 108 extend from the outsole 104 and are configured to contact and/or grip the ground or surface where the assembly 100 is used. The individual gripping features 108 can include any suitable shape and can be arranged in any suitable pattern for the tread portion 106 to accommodate different conditions. In the illustrated embodiment, for example, the gripping features 108 include multiple webs or ridges extending partially across the outsole 104 at a peripheral portion of the outsole 104, as well as multiple protrusions positioned at a center portion or mid-portion of the outsole 104. In other embodiments the tread portion 106 can include protrusions with different shapes, forms, and/or patterns. Moreover, in still further embodiments, the outsole 104 may not include any treads 108 in the tread portion 106.

According to another feature of the illustrated embodiment, the footwear assembly 102 includes multiple traction enhancing devices or studs 110 projecting from the outsole 104. More specifically, each stud 110 projects from a corresponding gripping feature 108. Each stud 110 is at least partially embedded in the corresponding gripping feature 108 and extends from the outsole 104 to increase or enhance the traction of the tread portion 106, thereby enhancing a user's traction on slippery or rough terrain. In certain embodiments, the studs 110 are made from steel, steel alloys, other suitable materials for traction enhancing studs 110. As described in detail below, each stud 110 is configured to be securely retained in the outsole 104, and to prevent the stud 110 from loosening or falling out of the outsole 104 over the life of the outsole. Moreover, although the illustrated embodiment includes the studs 110 embedded in the corresponding gripping features 108, in other embodiments the studs 110 can be embedded directly into the outsole 104 without any of the gripping features 108.

The studs 110 can be embedded in any of the gripping features 108 of the tread portion 106, or in any other portions of the outsole 104. For example, although the illustrated embodiment shows the studs 110 positioned in a few individual gripping features 108 throughout the tread portion 106, in other embodiments the studs 110 can be embedded in all of the gripping features 108, in the gripping features 108 in the mid-portion of the outsole 104, in the gripping features 108 around the peripheral portion of the outsole 104, and/or any other combination or pattern of the gripping features 108. Moreover, multiple studs 110 can be embedded in a single gripping feature 108. In addition, in certain embodiments the gripping features 108 can be integrally formed with the outsole 108. In other embodiments, however, the gripping features 108 can be removably attached to the outsole 104, for example, with a removable web or similar system.

Figure 2:
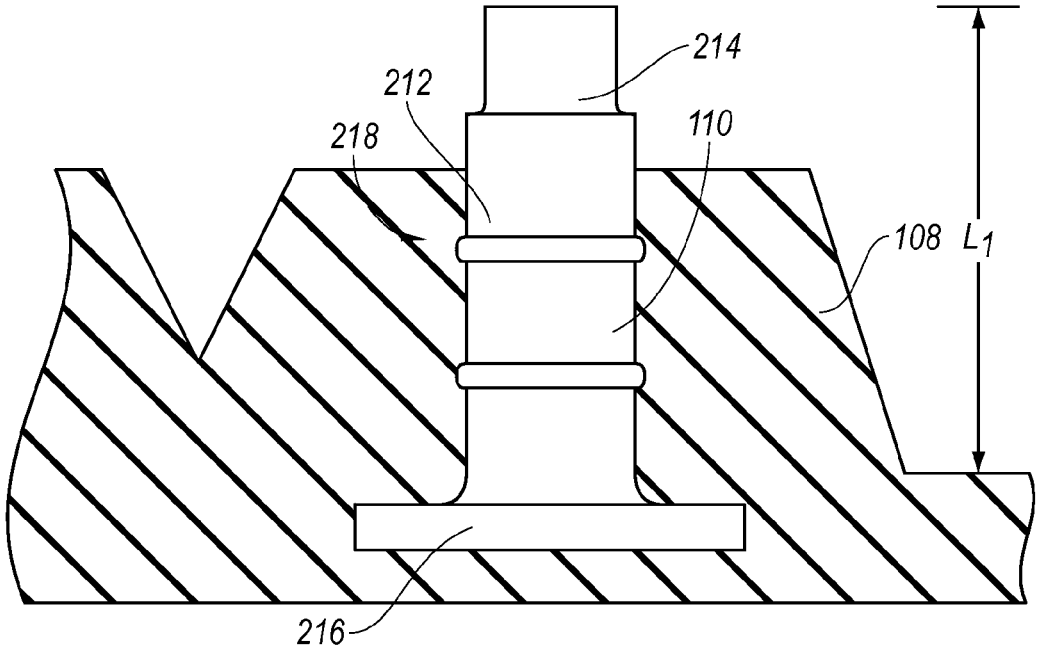
FIG. 2 is a partial cross-sectional, side view of an embedded traction enhancing device configured in accordance with an embodiment of the disclosure.

FIG. 2 is a partial cross-sectional side view of one of the studs 110 partially embedded in a corresponding gripping feature 108 as shown in FIGS. 1A and 1B. In the illustrated embodiment, the stud 110 includes a shaft 212 that has an engagement portion 218, a traction portion or tip 214, and an enlarged anchor or head 216 opposite the tip 214. The head 216 and at least a portion of the shaft 212 are embedded in the gripping feature 108 or other part of the outsole 104. The shaft 212 has an overall first length $L_1$ that is sufficiently long to expose the tip 214 and/or project the tip 214 from the gripping feature 108. The head 216 acts as an anchor to retain the stud 110 in the gripping feature 108 so that during use a portion of the stud 110 remains embedded in the outsole 104. More specifically, the head 216 resists movement of the stud 110 in an axial direction of the shaft 212 (e.g., in a direction generally parallel to a longitudinal axis of the shaft 212). In this manner, the stud 110 will not retract into the gripping feature 108 so as to remain in position to securely engage the uneven, rough or slippery terrain or surface.

In the illustrated embodiment, the gripping feature 108 and/or the outsole 104 are constructed of materials so that at least the tip 214 of the stud 110 remains exposed to engage the ground or other surface. Accordingly, the studs 110 are substantially not retractable under the weight of a wearer while standing, walking, or running on hard ground or a hard surface. Moreover, in certain embodiments and as explained in detail below, the studs 110 can also include several features that at least partially prevent the studs 110 from retracting or compressing into the corresponding gripping feature 108 or other portion of the outsole 104.

In the illustrated embodiment, the textured engagement portion 218 of the shaft 212 is configured to securely engage the interior material of the gripping feature 108 and resist axial movement of the shaft 212 into or away from the gripping feature 108. Accordingly, the head 216 and textured engagement portion 218 act to fixedly hold the stud 210 in the gripping feature 108 and prevent the stud 210 from loosening, falling out or being inadvertently pulled out of the gripping feature 108. As described in detail below, studs 110 configured in accordance with other embodiments of the disclosure can include other retention features to help retain the studs 110 in the outsole 104.

Figure 3A:
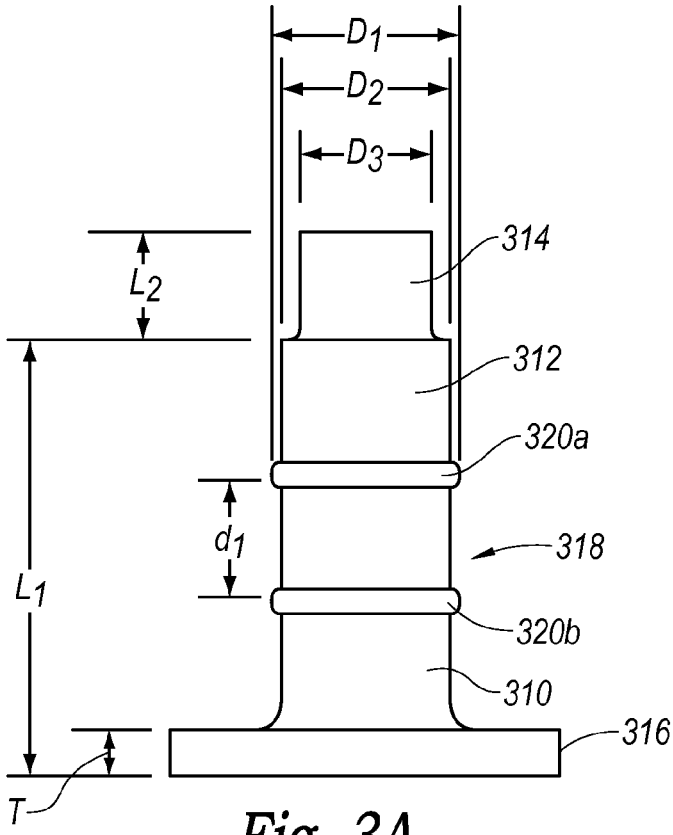
FIGS. 3A-4 are side views of a traction enhancing devices configured in accordance with embodiments of the disclosure.

FIG. 3A is a side view of a stud 310 configured in accordance with another embodiment of the disclosure. The illustrated stud 310 includes several features that are generally similar in structure and function to corresponding features of the studs 110 described above with reference to FIGS. 1A-2. For example, the stud 310 has a shaft 312 with a tip 314 opposite an anchor or head 316. In the illustrated embodiment, the shaft 312 also includes an engagement portion 318 spaced apart from the head 316. The engagement portion 318 is configured to engage the outsole or other carrying portion of the corresponding footwear product in which the stud 310 is embedded in (e.g., the treads 108 or any part of the tread portion 106 or outsole 104 of FIGS. 1A and 1B). More specifically, in the illustrated embodiment the engagement portion 318 includes multiple rings or ribs 320 (identified individually as a first rib 320*a* and a second rib 320*b*). Although the illustrated embodiment includes two ribs 320, in other embodiments the engagement portion 318 can include more or less than two ribs 320. The ribs 320 form a series of alternating valleys and peaks in the shaft 312 that increase the surface area of the engagement portion 318 to enhance engagement of the shaft 312 with the outsole. More specifically, the ribs 320 provide an increased surface area of the shaft 312 at the engagement portion 318 per unit length of the shaft 312. In this manner, the ribs 320 can engage the rubber outsole to reduce relative movement between the stud 310 and the outsole. The ribs 320 can be rolled, machined, or otherwise integrally formed in the engagement portion of the stud shaft 312. According to another feature of the illustrated embodiment, the stud 310 can be made from steel, such as C10B21 steel having a Rockwell hardness of approximately 41-47 and a #10 zinc finish. In other embodiments, however, the stud 310 can be made from other materials and/or have a different hardness and finish.

In other embodiments, however, the ribs 320 can be applied (e.g., adhered, welded, etc.) to the shaft 312 and extend from the exterior surface of the shaft 312. Moreover, in other embodiments, the engagement portion 318 can include threads or other features having shapes different from the illustrated embodiment. For example, the engagement portion can have one or more protrusions extending laterally from the shaft 312. In one embodiment, the ribs 320 can have a saw-tooth or other acute shape that acts substantially like a barb that will dig into the material of the outsole when a force is applied to the stud 310 axially away from the outsole. In other embodiments, the ribs 320 can have rounded surfaces extending radially from the shaft so as to form an annular shoulder projecting from the shaft 312 to securely engage the material of the outsole.

According to another feature of the illustrated embodiment, the diameter of the head 316 is significantly larger than the diameter of the shaft 312. In certain embodiments, for example, the diameter of the head 316 can be at least two to three times larger than the diameter of the shaft 312. In other embodiments, the diameter of the head can be less than or greater than two to three times the diameter off the shaft 312. The larger diameter of the head 316 relative to the diameter of the shaft 312 can provide greater retention of the stud 310 in an outsole of a footwear product. In addition, the stud 310 can be sufficiently long to allow more of the shaft 312 to be embedded in the outsole. Accordingly, these features at least partially help to resist movement of the stud 310 with reference to the outsole as forces are applied at the tip 314 of the stud 310 during use. For example, the engagement portion 318 and the head 316 can at least partially prevent the stud 310 from retracting or compressing into a rubber outsole during use.

Figure 3B:
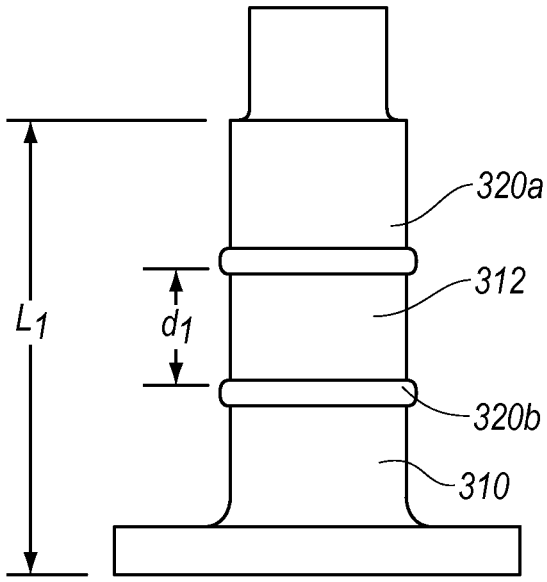

According to additional features of the embodiment illustrated in FIG. 3A, several representative dimensions of the stud 310 are shown in FIG. 3A. Although several representative dimensions are described with reference to the stud 310 illustrated in FIG. 3A, one of ordinary skill in the art will appreciate that the present disclosure is not limited to these dimensions. In the illustrated embodiment, the shaft 312 includes a first length $L_1$ and the tip 314 includes a second length $L_2$. Moreover, the first rib 320*a* is spaced apart from the second rib 320*b* by a first distance $d_1$, and the head 316 has a thickness T. Moreover, the ribs 320 have a first overall dimension or diameter $D_1$, the shaft 312 has a second overall dimension or diameter $D_2$, and the tip 314 has a third overall dimension or diameter $D_3$. In certain embodiments, the overall first length $L_1$ can be approximately 5/16 inch, the second length $L_2$ can be approximately 5/64 inch, the first distance $d_1$ can be approximately 1/16 inch, the thickness T can be approximately 1/32 inch, the first overall dimension or diameter $D_1$ can be approximately 9/64 inch, the second overall dimension or diameter $D_2$ can be approximately 1/8 inch, and the third overall dimension or diameter $D_3$ can be approximately 3/32 inch. In other embodiments, however, each of these dimensions can be greater or less than these illustrative dimensions. For example, FIG. 3B is a side view of the stud 310 with a first length $L_1$ and a first distance $d_1$ that are greater than the corresponding dimensions shown in FIG. 3A. More specifically, in the embodiment illustrated in FIG. 3B, the first length $L_1$ can be approximately 5/16 inch, and the first distance $d_1$ can be approximately 3/32 inch. In other embodiments, however, these dimensions can be greater or less than these values.

Figure 4:
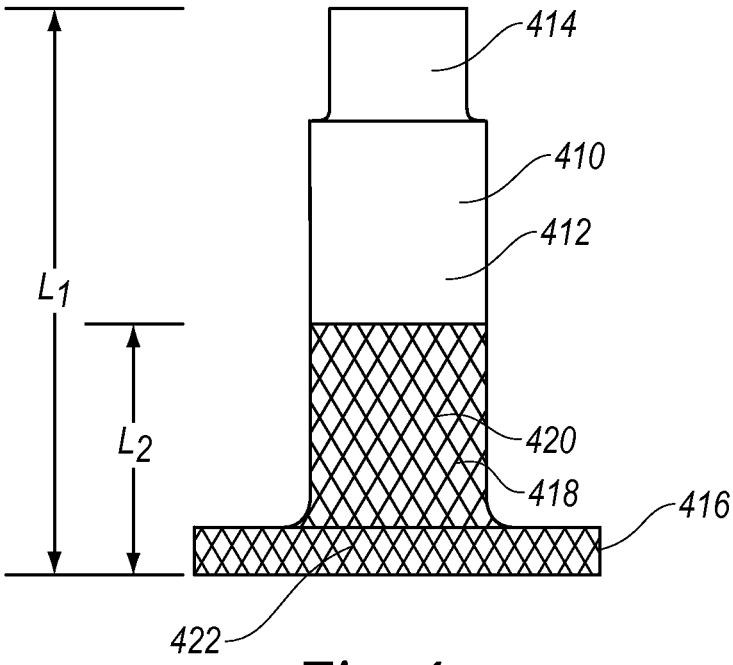

FIG. 4 is a side view of a stud 410 configured in accordance with another embodiment of the disclosure. The illustrated stud 410 includes several features that are generally similar in structure and function to corresponding features of the studs 110, 310, described above with reference to FIGS. 1A-3B. For example, the stud 410 and has an overall first length $L_1$ and includes a shaft 412 with a tip 414 opposite a head 416. The shaft 412 also includes a retention portion 418 that is configured to engage the corresponding outsole. More specifically, the illustrated retention portion 418 of the shaft 412 has a textured exterior surface 420. In addition, the head 416 can also include a textured exterior surface 422. In certain embodiments, these textured surfaces can be knurled, ribbed, threaded, etc., or include other surfaces or surface treatments that increase the friction associated with these portions of the stud 410. Moreover, the retention portion 418 of the shaft 412 can have a second length $L_2$ that is less than the overall first length $L_1$ so that a non-textured portion of the shaft 412 and the tip 414 extend from the outsole to provide traction. In other embodiments, the entire external surface of the stud 410 can be textured to enhance the grip or engagement of the surfaces stud 410 that are in contact with the outsole. Accordingly, the textured portions of the stud 410 help to engage the rubber material of the outsole and reduce relative movement between the stud 410 and the outsole.

Figure 5:
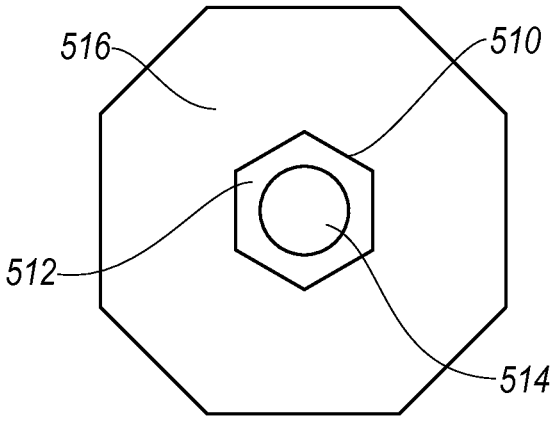
FIG. 5 is a top plan view of a traction enhancing device configured in accordance with yet another embodiment of the disclosure.

FIG. 5 is a top plan view of a stud 510 configured in accordance with yet another embodiment of the disclosure. The stud of 510 includes several features that are generally similar in structure and function to corresponding features of the studs 110, 310, 410 described above with reference to FIGS. 1A-4. For example, the stud 510 includes a shaft 512 with a tip 514 opposite a head 516. In the illustrated embodiment, however, the head 516 has an octagonal shape, and the shaft 512 has a hexagonal shape. The polygonal shapes of the head 516 and the shaft 512 can at least partially resist rotational movement of the stud 510 embedded in an outsole. For example, the stud 510 can resist rotating and loosening in an outsole when a user twists their foot or changes direction when walking. One skilled in the art will appreciate that the head 516 and the shaft 512 can have other polygonal shapes, as well as the same polygonal shapes, and are not limited to the octagonal and hexagonal shapes in the illustrated embodiment.

Figure 6:
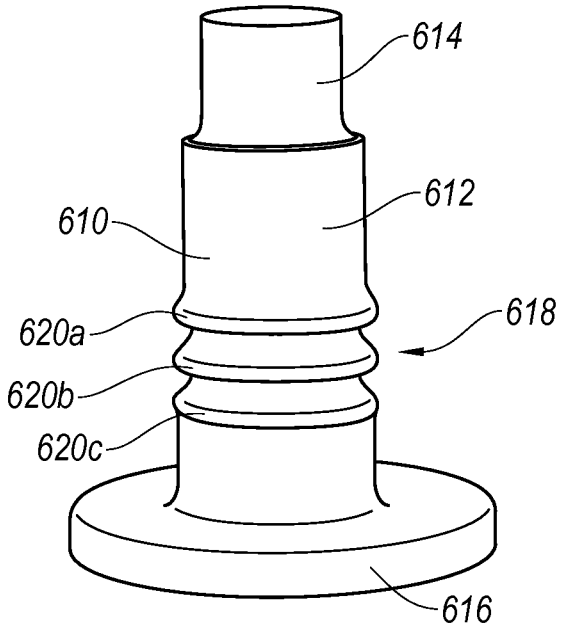
FIG. 6 is an isometric side view of a traction enhancing device configured in accordance with yet another embodiment of the disclosure.

FIG. 6 is an isometric side view of a stud 610 configured in accordance with another embodiment of the disclosure. The stud 610 includes several features that are generally similar in structure and function to corresponding features of the studs 110, 310, 410, 510 described above with reference to FIGS. 1A-6. For example, the stud 610 includes a shaft 612 with a tip 614 opposite a head 616, and a retention portion 618. In the illustrated embodiment, however, the retention portion 618 includes three retention features or ribs 620 (identified individually as a first rib 620*a*, a second rib 620*b*, and a third rib 620*b*). In other embodiments, however, the stud 610 can have greater or less than three ribs 620.

From the foregoing, it will be appreciated that specific embodiments of the disclosure have been described herein for purposes of illustration, but that various modifications may be made without deviating from the spirit and scope of the disclosure. For example, although many of the Figures described above illustrate the traction devices embedded in an outsole of a footwear product, in other footwear assemblies the traction devices can be embedded in traction enhancing webs that can be removably attached to footwear products. Further, while various advantages associated with certain embodiments of the disclosure have been described above in the context of those embodiments, other embodiments may also exhibit such advantages, and not all embodiments need necessarily exhibit such advantages to fall within the scope of the disclosure. Moreover, features described with reference to certain embodiments may be combined with other embodiments of the disclosure.

We claim:

1. A footwear assembly comprising:

a footwear product having an outsole; and multiple studs projecting from the outsole and configured to increase traction of the outsole, the individual studs comprising:

a head portion embedded in the outsole and configured to anchor the stud in the outsole, the head portion having a head portion diameter; and a shaft portion extending from the head portion, the shaft portion comprising:

an engagement portion at least partially embedded in the outsole and having a textured surface configured to engage the outsole and resist relative movement between the stud and the outsole, the engagement portion having an engagement portion diameter less than the head portion diameter, a rib extending circumferentially around the shaft portion, the rib having a rib diameter less than the head portion diameter and greater than the shaft portion diameter; and a tip portion adjacent to the engagement portion opposite the head portion, wherein the tip portion extends away from the outsole under the full weight of a wearer, and wherein the tip portion has a tip portion diameter less than the shaft portion diameter.

2. The footwear assembly of claim 1 wherein the textured surface of the engagement portion of each stud is configured to resist relative movement between the stud and the outsole in a direction generally parallel to a longitudinal axis of the stud.

3. The footwear assembly of claim 1 wherein the shaft portion further comprises a non-engagement portion having a first surface area per unit length, and wherein the engagement portion has a second surface area per unit length that is greater than the first surface area.

4. The footwear assembly of claim 1 where the outsole comprises multiple tread portions, and wherein individual studs project from the corresponding tread portions.

5. The footwear assembly of claim 1 wherein the studs are made from steel.

6. The footwear assembly of claim 1 wherein the studs have a Rockwell hardness of approximately 41-47.

7. The footwear assembly of claim 1 wherein the second diameter is approximately two to three times smaller than the first diameter.

8. A footwear assembly comprising:

a footwear product having a carrier portion;

a traction enhancing device secured to the carrier portion, the traction enhancing device comprising:

a first end portion embedded in the carrier portion, the first end portion having a first end portion diameter;

a middle portion adjacent to the first end portion, wherein the middle portion has a textured engagement surface configured to securely engage the carrier portion and to retain the traction enhancing device substantially stationary relative to the carrier portion, wherein the middle portion further includes— a first section having— a first section diameter less than the first end portion diameter, and a first section surface area per unit length; and a second section adjacent the first section and having a second section diameter greater than the first section diameter and less than the first end portion diameter, wherein the second section has a second section surface area per unit length greater than the first section surface area per unit length; and a second end portion adjacent to the middle portion, the second end portion having a second end portion diameter less than the second section diameter, wherein the second end portion extends away from the carrier portion when under the full weight of a wearer wherein the second section of the middle portion includes one or more retention features extending laterally away from the traction enhancing device into the carrier portion; and wherein the one or more retention features include one or more rings extending radially around the traction enhancing device.

9. The footwear assembly of claim 8 wherein the one or more retention features are configured to resist axial movement of the traction enhancing device relative to the carrier portion.

10. A traction enhancing device configured to be partially embedded in a carrier portion of an outsole of a footwear assembly and project from a bottom surface of the outsole, the traction enhancing device comprising:

an anchor configured to be embedded in the outsole, the anchor having a first diameter;

a shaft extending from the anchor and configured to be at least partially embedded in the carrier portion, the shaft having a second diameter less than the first diameter, wherein the shaft includes a rib extending radially away from the shaft configured to engage the carrier portion and resist relative movement between the traction enhancing device and the carrier portion, and wherein the rib has a third diameter greater than the second diameter and less than the first diameter; and a tip extending from the shaft opposite the anchor and, when under the full weight of a wearer, configured to be spaced apart from the bottom surface of the outsole when the traction enhancing device is partially embedded in the outsole, wherein the tip has a fourth diameter less than the second diameter.

11. The traction enhancing device of claim 10 wherein the rib is configured to resist the relative movement in a direction generally parallel with a longitudinal axis of the shaft.

12. The traction enhancing device of claim 10 wherein the ribs have an increased surface area relative to other portions of the shaft.

13. The traction enhancing device of claim 10 wherein the rib includes a rounded surface extending radially from the shaft.

14. The traction enhancing device of claim 10 wherein the rib is a first rib and wherein the traction enhancing device further includes a second rib positioned along the shaft spaced apart from the first rib.

* * * * *